US010326226B2

(12) United States Patent
Wang et al.

(10) Patent No.: US 10,326,226 B2
(45) Date of Patent: Jun. 18, 2019

(54) CONTACT WITH A FIRST CYLINDRICAL SECTION, A SECOND CYLINDRICAL SECTION, AND A TRANSITION SECTION AND A CONNECTOR USING THE SAME

(71) Applicant: Tyco Electronics (Shanghai) Co. Ltd., Shanghai (CN)

(72) Inventors: Hao Wang, Shanghai (CN); Hongjun Yin, Shanghai (CN); Yuquan Chen, Shanghai (CN); Qijun Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/800,525

(22) Filed: Nov. 1, 2017

(65) Prior Publication Data

US 2018/0123277 A1 May 3, 2018

(30) Foreign Application Priority Data

Nov. 1, 2016 (CN) ..... 2016 1 0971160

(51) Int. Cl.

| | |
|---|---|
| ***H01R 4/18*** | (2006.01) |
| ***H01R 13/428*** | (2006.01) |
| ***H01R 4/58*** | (2006.01) |
| *H01R 9/24* | (2006.01) |
| *H01R 4/26* | (2006.01) |
| *H01R 9/05* | (2006.01) |
| *H01R 11/28* | (2006.01) |
| *H01R 12/65* | (2011.01) |
| *H01R 9/00* | (2006.01) |
| *H01R 43/048* | (2006.01) |

(52) U.S. Cl.
CPC ..... *H01R 13/428* (2013.01); *H01R 4/185* (2013.01); *H01R 4/58* (2013.01); *H01R 4/26* (2013.01); *H01R 9/00* (2013.01); *H01R 9/0518* (2013.01); *H01R 9/24* (2013.01); *H01R 11/28* (2013.01); *H01R 12/65* (2013.01); *H01R 43/048* (2013.01)

(58) Field of Classification Search
CPC .... H01R 4/185; H01R 43/048; H01R 9/0518; H01R 9/00; H01R 9/24; H01R 4/26; H01R 11/28; H01R 12/65
USPC ..... 439/877, 585, 733.1, 722, 884, 444
See application file for complete search history.

(56) References Cited

U.S. PATENT DOCUMENTS

| | | | | |
|---|---|---|---|---|
| 4,799,904 A * | 1/1989 | Sutcliffe | ..... | H01R 12/58 439/733.1 |
| 7,867,027 B2 * | 1/2011 | Sakaguchi | ..... | H01R 9/0518 439/585 |
| 8,029,325 B2 * | 10/2011 | Bardet | ..... | H01R 13/41 439/660 |

* cited by examiner

*Primary Examiner* — Abdullah A Riyami
*Assistant Examiner* — Justin M Kratt
(74) *Attorney, Agent, or Firm* — Barley Snyder

(57) ABSTRACT

A contact comprises a first cylindrical section, a second cylindrical section, and a transition section connected between the first cylindrical section and the second cylindrical section. The first cylindrical section has a first peripheral wall with a first diameter and a first protrusion rib disposed on the first peripheral wall. The second cylindrical section has a second peripheral wall with a second diameter less than the first diameter and a second protrusion rib disposed on the second peripheral wall.

16 Claims, 3 Drawing Sheets

CONTACT WITH A FIRST CYLINDRICAL SECTION, A SECOND CYLINDRICAL SECTION, AND A TRANSITION SECTION AND A CONNECTOR USING THE SAME

CROSS-REFERENCE TO RELATED APPLICATION

This application claims the benefit of the filing date under 35 U.S.C. § 119(a)-(d) of Chinese Patent Application No. 201610971160.X, filed on Nov. 1, 2016.

FIELD OF THE INVENTION

The present invention relates to an electrical connector and, more particularly, to a contact of the electrical connector.

BACKGROUND

Known electrical connectors generally have an insulative body and a contact disposed in the insulative body. A rear end of the contact is crimped on a conductor of a wire and a front end of the contact is mated with a contact of a mating connector.

The contact is commonly formed by stamping and bending a metal plate and a gap is disposed between the contact and the insulative body after the contact is assembled into the insulative body. As a result, the contact is movable within the insulative body and may be easily offset from its correct installation position. A large positional deviation may occur after the contact is assembled into the insulative body, leading to an unreliable electrical connection between the connector and the mating connector.

SUMMARY

A contact according to the invention comprises a first cylindrical section, a second cylindrical section, and a transition section connected between the first cylindrical section and the second cylindrical section. The first cylindrical section has a first peripheral wall with a first diameter and a first protrusion rib disposed on the first peripheral wall. The second cylindrical section has a second peripheral wall with a second diameter less than the first diameter and a second protrusion rib disposed on the second peripheral wall.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
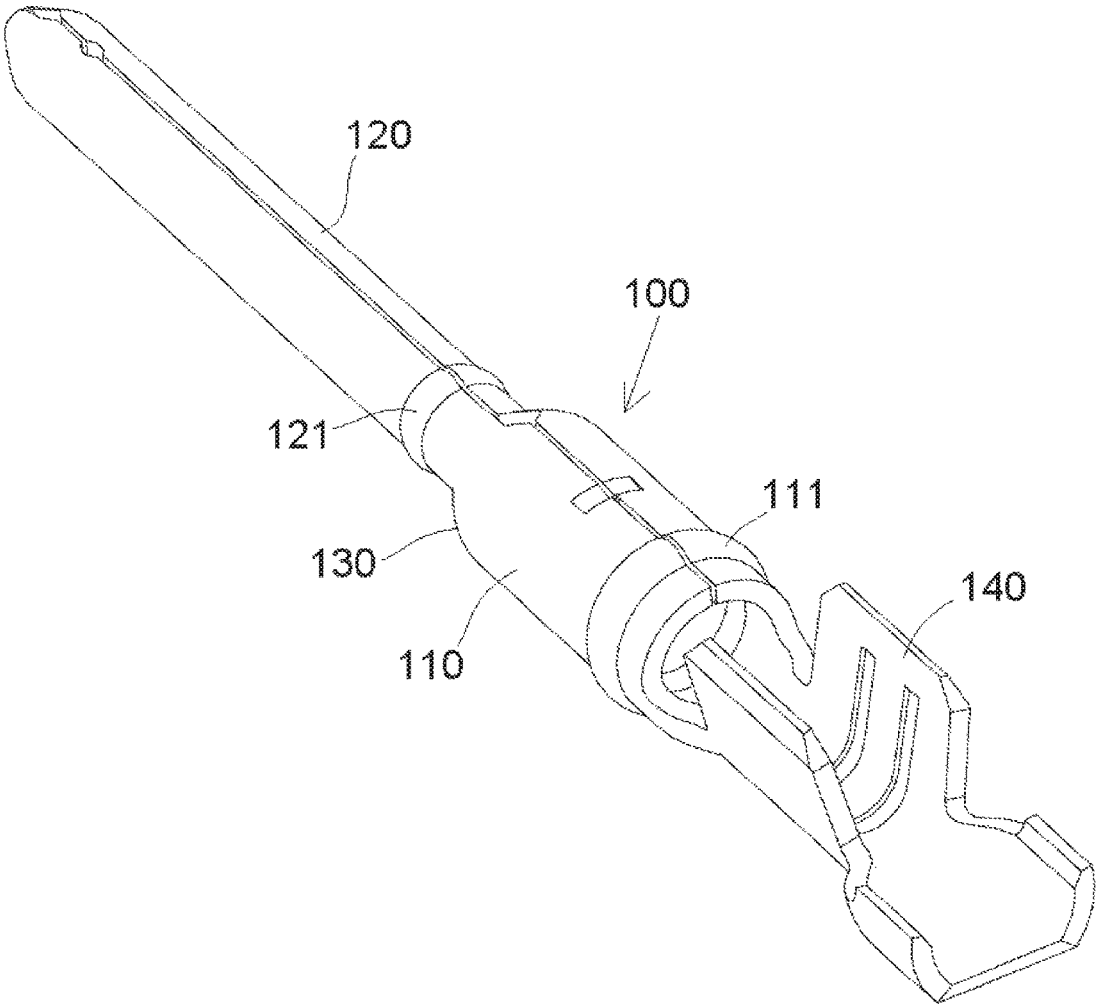
FIG. 1 is a perspective view of a contact according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 4:
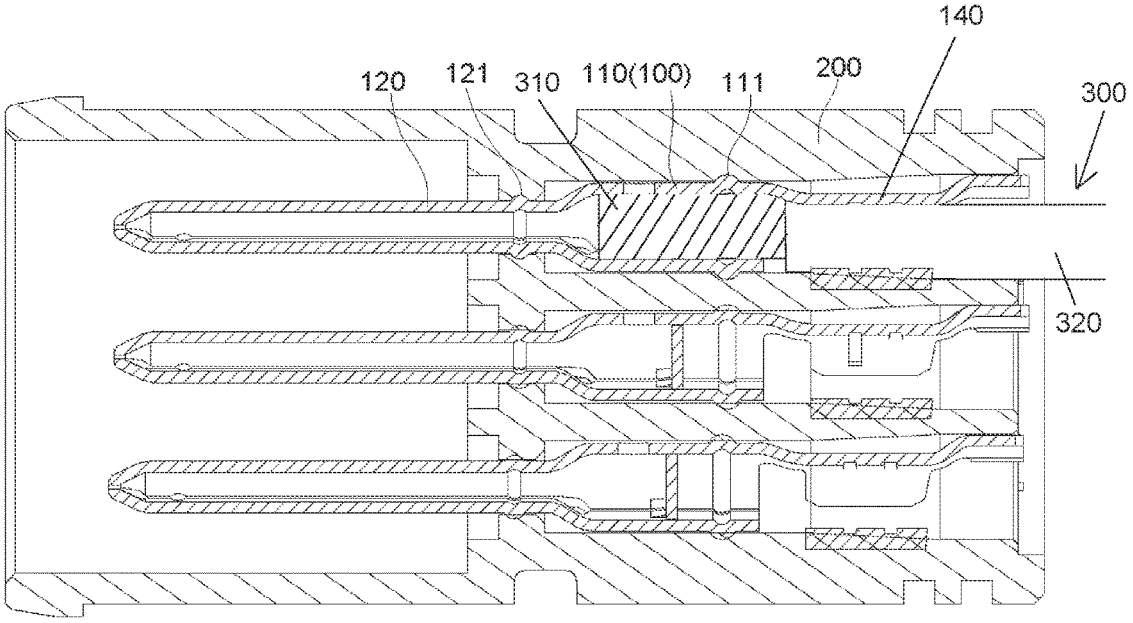
FIG. 4 is a sectional view of a connector according to an embodiment of the invention having the contact of FIG. 1.

A connector according to the invention is shown in FIG. 4. The connector comprises an insulative body 200 and at least one contact 100 disposed in the insulative body 200. A first end of the contact 100, a right end in the orientation of FIG. 4, is electrically connected to a conductor 310 of a wire 300. A second end of the contact 100 opposite the first end, a left end in the orientation of FIG. 4, is electrically mated with a contact of a mating connector (not shown). In an embodiment, the contact 100 is monolithically formed by stamping and bending a single metal plate.

Figure 2:
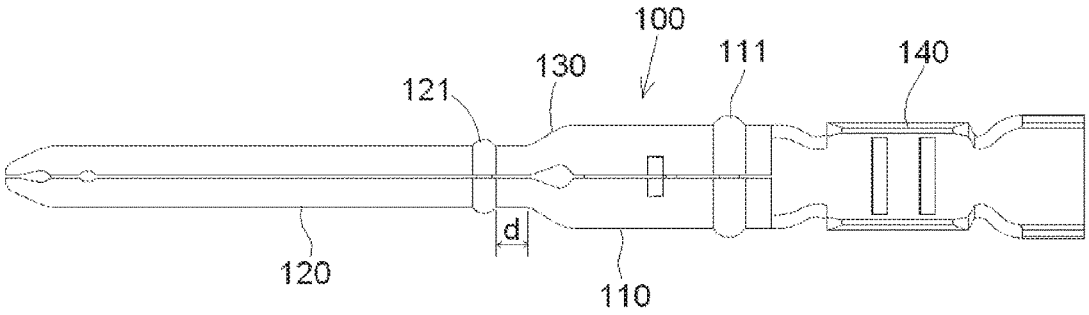
FIG. 2 is a top view of the contact of FIG. 1.
Figure 3:
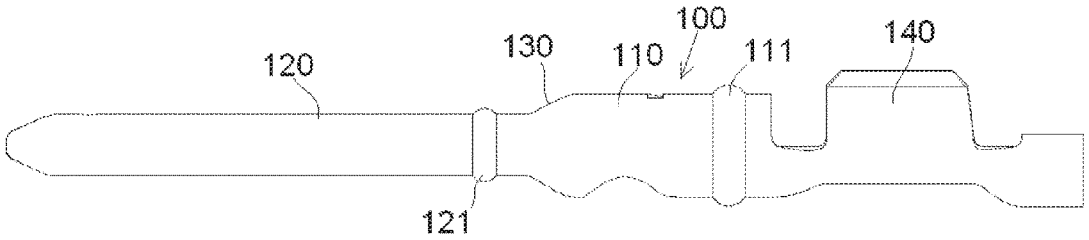
FIG. 3 is a side view of the contact of FIG. 1.

The contact 100, as shown in FIGS. 1-3, comprises a first cylindrical section 110 at a first end of the contact 100, a second cylindrical section 120 at an opposite second end of the contact 100, a transition section 130 between the first cylindrical section 110 and the second cylindrical section 120, and a wing 140 connected to the first cylindrical section 110.

As shown in FIGS. 1-3, the second cylindrical section 120 has a diameter less than that of the first cylindrical section 110. The transition section 130 is connected between a second end of the first cylindrical section 110 and a first end of the second cylindrical section 120. A diameter of the transition section 130 is gradually reduced from a diameter equal to the first cylindrical section 110 at the first cylindrical section 110 to a diameter equal to the second cylindrical section 120 at the second cylindrical section 120, so as to realize a smooth transition between the first cylindrical section 110 and the second cylindrical section 120.

As shown in FIGS. 1-3, the contact 100 has a first protrusion rib 111 disposed circumferentially around a first peripheral wall of the first cylindrical section 110 and a second protrusion rib 121 disposed circumferentially around a second peripheral wall of the second cylindrical section 120. In an embodiment, the first protrusion rib 111 and the second protrusion rib 121 each have a circular cross section.

The second protrusion rib 121, as shown in FIG. 2, is positioned adjacent the transition section 130 and spaced apart from the transition section 130 by a predetermined distance d in a longitudinal direction of the contact 100. The positioning of the second protrusion rib 121 reduces the difficulty of forming the contact 100 by stamping, ensuring the shape and dimensional precision of the second protrusion rib 121. In an embodiment, the predetermined distance d is set according to an actual situation; the predetermined distance d may be set to be greater than 1/50 of a total length of the contact 100 and less than 1/10 of the total length of the contact 100.

The wing 140, as shown in FIGS. 1-3, is connected to a first end of the first cylindrical section 110 opposite the second end of the first cylindrical section 110 connected to the transition section 130. The wing 140, as shown in FIG. 4, is adapted to be crimped around an outer insulation layer 320 of the wire 300 while the first cylindrical section 110 is adapted to be crimped around the conductor 310 of the wire 300 inserted into the first cylindrical section 110. The wire 300 is fixed and electrically connected to the first end of the contact 100.

As shown in FIG. 4, when the contact 100 is inserted into the insulative body 200, the first protrusion rib 111 and the second protrusion rib 121 each engage the insulative body 200 by an interference fit. The contact 100 is thereby positioned in the insulative body 200 at a plurality of different points and is reliably fixed in the insulative body

200. The first protrusion rib 111 and the second protrusion rib 121 effectively prevent the contact 100 from being offset from its correct installation position in the insulative body 200, improving the reliability of the electrical connection between the connector and the mating connector to be mated with the connector.

What is claimed is:

1. A contact, comprising:

a first cylindrical section having a first peripheral wall with a first diameter and a first protrusion rib disposed on the first peripheral wall; and a wing connected to an end of the first cylindrical section disposed around an outer insulation layer of a wire and the first cylindrical section is crimped on a conductor of the wire inserted into the first cylindrical section; and a second cylindrical section having a second peripheral wall with a second diameter less than the first diameter and a second protrusion rib disposed on the second peripheral wall; and a transition section connected between the first cylindrical section and the second cylindrical section.

2. The contact of claim 1, wherein the first protrusion rib and the second protrusion rib each have a circular cross section.

3. The contact of claim 1, wherein the first protrusion rib extends circumferentially around the first peripheral wall and the second protrusion rib extends circumferentially around the second peripheral wall.

4. The contact of claim 1, wherein the second protrusion rib is positioned adjacent the transition section and is spaced apart from the transition section by a predetermined distance in a longitudinal direction of the contact.

5. The contact of claim 4, wherein the predetermined distance is greater than 1/50 of a total length of the contact and less than 1/10 of the total length of the contact.

6. The contact of claim 1, wherein the end of the first cylindrical section is opposite the transition section.

7. The contact of claim 1, wherein a diameter of the transition section is gradually reduced from being equal to the first diameter at the first cylindrical section to being equal to the second diameter at the second cylindrical section.

8. The contact of claim 1, wherein the contact is monolithically formed from a single metal plate.

9. A connector, comprising:

an insulative body; and at least one contact disposed in the insulative body, the contact including a first cylindrical section having a first peripheral wall with a first diameter and a first protrusion rib disposed on the first peripheral wall and a wing connected to an end of the first cylindrical section the wing is disposed around an outer insulation layer of a wire and the first cylindrical section is crimped on a conductor of the wire inserted into the first cylindrical section, a second cylindrical section having a second peripheral wall with a second diameter less than the first diameter and a second protrusion rib disposed on the second peripheral wall, and a transition section connected between the first cylindrical section and the second cylindrical section, the first protrusion rib and the second protrusion rib engaging the insulative body by an interference fit.

10. The connector of claim 9, wherein the first protrusion rib and the second protrusion rib each have a circular cross section.

11. The connector of claim 9, wherein the first protrusion rib extends circumferentially around the first peripheral wall and the second protrusion rib extends circumferentially around the second peripheral wall.

12. The connector of claim 9, wherein the second protrusion rib is positioned adjacent the transition section and is spaced apart from the transition section by a predetermined distance in a longitudinal direction of the contact.

13. The connector of claim 12, wherein the predetermined distance is greater than 1/50 of a total length of the contact and less than 1/10 of the total length of the contact.

14. The connector of claim 9, wherein the end of the first cylindrical section is opposite the transition section.

15. The connector of claim 9, wherein a diameter of the transition section is gradually reduced from being equal to the first diameter at the first cylindrical section to being equal to the second diameter at the second cylindrical section.

16. The connector of claim 9, wherein the contact is monolithically formed from a single metal plate.

* * * * *